US008492633B2

(12) United States Patent
Whitman et al.

(10) Patent No.: US 8,492,633 B2
(45) Date of Patent: Jul. 23, 2013

(54) MUSICAL FINGERPRINTING

(75) Inventors: Brian Whitman, Cambridge, MA (US); Andrew Nesbit, London (GB); Daniel Ellis, New York, NY (US)

(73) Assignee: The Echo Nest Corporation, Summerville, MA (US)

( * ) Notice: Subject to any disclaimer, the term of this patent is extended or adjusted under 35 U.S.C. 154(b) by 0 days.

(21) Appl. No.: 13/494,183

(22) Filed: Jun. 12, 2012

(65) Prior Publication Data

US 2013/0139674 A1 Jun. 6, 2013

Related U.S. Application Data

(63) Continuation-in-part of application No. 13/310,190, filed on Dec. 2, 2011.

(51) Int. Cl.

| | |
|---|---|
| ***A63H 5/00*** | (2006.01) |
| ***G04B 13/00*** | (2006.01) |
| ***G10H 7/00*** | (2006.01) |

(52) U.S. Cl.
USPC ..... 84/609

(58) Field of Classification Search
USPC ..... 84/609
See application file for complete search history.

(56) References Cited

U.S. PATENT DOCUMENTS

| | | | | |
|---|---|---|---|---|
| 6,453,252 | B1 | 9/2002 | Laroche | |
| 7,013,301 | B2 | 3/2006 | Holm et al. | |
| 7,080,253 | B2 * | 7/2006 | Weare | 713/176 |
| 7,081,579 | B2 | 7/2006 | Alcalde et al. | |
| 7,193,148 | B2 | 3/2007 | Cremer et al. | |
| 7,273,978 | B2 | 9/2007 | Uhle | |
| 7,277,766 | B1 | 10/2007 | Khan | |
| 7,487,180 | B2 | 2/2009 | Holm et al. | |
| 7,643,994 | B2 | 1/2010 | Kemp | |
| 8,071,869 | B2 | 12/2011 | Chen et al. | |
| 8,140,331 | B2 | 3/2012 | Lou | |
| 8,190,435 | B2 | 5/2012 | Wang et al. | |
| 8,195,689 | B2 * | 6/2012 | Ramanathan et al. | 707/769 |
| 8,290,423 | B2 | 10/2012 | Wang | |
| 2002/0181711 | A1 | 12/2002 | Logan et al. | |

(Continued)

OTHER PUBLICATIONS

Daniel Ellis et al., The Echo Nest Musical Fingerprint, Proceedings of the 2010 International Symposium on Music Information Retrieval, Aug. 12, 2010.

(Continued)

*Primary Examiner* — Jeffrey Donels
(74) *Attorney, Agent, or Firm* — SoCal IP Law Group LLP; John E. Gunther; Steven C. Sereboff

(57) ABSTRACT

A method for fingerprinting an unknown music sample is disclosed. A plurality of known tracks may be segmented into reference samples. A reference fingerprint including a plurality of codes may be generated for each reference sample. An inverted index including, for each possible code value, a list of reference samples having reference fingerprints that contain the respective code value may be generated. An unknown fingerprint including a plurality of codes may be generated from the unknown music sample. A code match histogram may list candidate reference samples and associated scores, each score indicating a number of codes from the unknown fingerprint that match codes in the reference fingerprint. Time difference histograms may be generated for two or more reference samples having the highest scores. A determination may be made whether or not a single reference sample matches the unknown music sample based on a comparison of the time difference histograms.

21 Claims, 7 Drawing Sheets

U.S. PATENT DOCUMENTS

| | | | | |
|---|---|---|---|---|
| 2003/0086341 | A1 | 5/2003 | Wells et al. | |
| 2003/0191764 | A1 | 10/2003 | Richards | |
| 2006/0096447 | A1 | 5/2006 | Weare et al. | |
| 2006/0149552 | A1 | 7/2006 | Bogdanov | |
| 2008/0201140 | A1* | 8/2008 | Wells et al. | 704/231 |
| 2012/0191231 | A1* | 7/2012 | Wang | 700/94 |

OTHER PUBLICATIONS

Daniel Ellis et al., Echoprint—An Open Music Identification Service, Proceedings of the 2011 International Symposium on Music Information Retrieval, Oct. 28, 2011.

* cited by examiner

© 2012 The Echo Nest

© 2012 The Echo Nest

© 2012 The Echo Nest

© 2012 The Echo Nest

© 2010 The Echo Nest

© 2010 The Echo Nest

© 2012 The Echo Nest

MUSICAL FINGERPRINTING

RELATED APPLICATION INFORMATION

This patent is a continuation-in-part of patent application Ser. No. 13/310,190, entitled Musical Fingerprinting Based on Onset Intervals, filed Dec. 2, 2011, which is incorporated herein by reference.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to developing a fingerprint of an audio sample and identifying the sample based on the fingerprint.

2. Description of the Related Art

The "fingerprinting" of large audio files is becoming a necessary feature for any large scale music understanding service or system. "Fingerprinting" is defined herein as converting an unknown music sample, represented as a series of time-domain samples, to a match of a known song, which may be represented by a song identification (ID). The song ID may be used to identify metadata (song title, artist, etc.) and one or more recorded tracks containing the identified song (which may include tracks of different bit rate, compression type, file type, etc.). The term "song" refers to a musical performance as a whole, and the term "track" refers to a specific embodiment of the song in a digital file. Note that, in the case where a specific musical composition is recorded multiple times by the same or different artists, each recording is considered a different "song". The term "music sample" refers to audio content presented as a set of digitized samples. A music sample may be all or a portion of a track, or may be all or a portion of a song recorded from a live performance or from an over-the-air broadcast.

Examples of fingerprinting have been published by Haitsma and Kalker (A highly robust audio fingerprinting system with an efficient search strategy, *Journal of New Music Research,* 32(2):211-221, 2003), Wang (An industrial strength audio search algorithm, *International Conference on Music Information Retrieval* (*ISMIR*)2003), and Ellis, Whitman, Jehan, and Lamere (The Echo Nest musical fingerprint, *International Conference on Music Information Retrieval* (*ISMIR*)2010).

Fingerprinting generally involves compressing a music sample to a code, which may be termed a "fingerprint", and then using the code to identify the music sample within a database or index of songs.

Elements in figures are assigned three-digit reference designators, wherein the most significant digit is the figure number where the element was introduced. Elements not described in conjunction with a figure may be presumed to have the same form and function as a previously described element having the same reference designator.

DETAILED DESCRIPTION

Description of Processes

Figure 1:
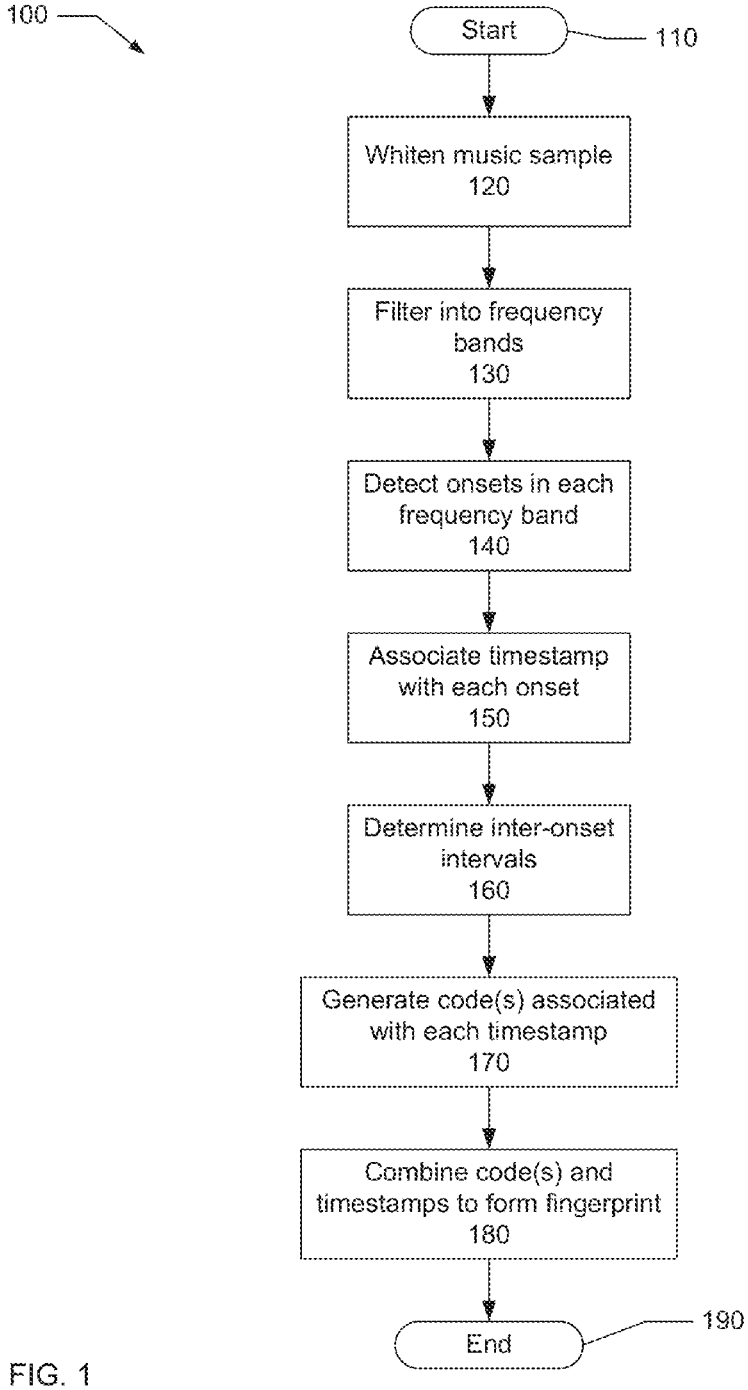
FIG. 1 is a flow chart of a process for generating a fingerprint of a music sample.

FIG. 1 shows a flow chart of a process 100 for generating a fingerprint representing the content of a music sample, as described in patent application Ser. No. 13/310,190. The process 100 may begin at 110, when the music sample is provided as a series of digitized time-domain samples, and may end at 190 after a fingerprint of the music sample has been generated. The process 100 may provide a robust reliable fingerprint of the music sample based on the relative timing of successive onsets, or beat-like events, within the music sample. In contrast, previous musical fingerprints typically relied upon spectral features of the music sample in addition to, or instead of, temporal features like onsets.

At 120, the music sample may be "whitened" to suppress strong stationary resonances that may be present in the music sample. Such resonances may be, for example, artifacts of the speaker, microphone, room acoustics, and other factors when the music sample is recorded from a live performance or from an over-the-air broadcast. "Whitening" is a process that flattens the spectrum of a signal such that the signal more closely resembles white noise (hence the name "whitening").

At 120, the time-varying frequency spectrum of the music sample may be estimated. The music sample may then be filtered using a time-varying inverse filter calculated from the frequency spectrum to flatten the spectrum of the music sample and thus moderate any strong resonances. For example, at 120, a linear predictive coding (LPC) filter may be estimated from the autocorrelation of one second blocks for the music sample, using a decay constant of eight seconds. An inverse finite impulse response (FIR) filter may then be calculated from the LPC filter. The music sample may then be filtered using the FIR filter. Each strong resonance in the music sample may be thus moderated by a corresponding zero in the FIR filter.

At 130, the whitened music sample may be partitioned into a plurality of frequency bands using a corresponding plurality of band-pass filters. Ideally, each band may have sufficient bandwidth to allow accurate measurement of the timing of the music signal (since temporal resolution has an inverse relationship with bandwidth). At the same time, the probability that a band will be corrupted by environmental noise or channel effects increases with bandwidth. Thus the number of bands and the bandwidths of each band may be determined as a compromise between temporal resolution and a desire to obtain multiple uncorrupted views of the music sample.

For example, at 130, the music sample may be filtered using the lowest eight filters of the MPEG-Audio 32-band filter bank to provide eight frequency bands spanning the frequency range from 0 to about 5500 Hertz. More or fewer than eight bands, spanning a narrower or wider frequency range, may be used. The output of the filtering will be referred to herein as "filtered music samples", with the understanding that each filtered music sample is a series of time-domain samples representing the magnitude of the music sample within the corresponding frequency band.

At 140, onsets within each filtered music sample may be detected. An "onset" is the start of period of increased magnitude of the music sample, such as the start of a musical note or percussion beat. Onsets may be detected using a detector for each frequency band. Each detector may detect increases in the magnitude of the music sample within its respective frequency band. Each detector may detect onsets, for example, by comparing the magnitude of the corresponding filtered music sample with a fixed or time-varying threshold derived from the current and past magnitude within the respective band.

At 150, a timestamp may be associated with each onset detected at 140. Each timestamp may indicate when the associated onset occurs within the music sample, which is to say the time delay from the start of the music sample until the occurrence of the associated onset. Since extreme precision is not necessarily required for comparing music samples, each timestamp may be quantized in time intervals that reduce the amount of memory required to store timestamps within a fingerprint, but are still reasonably small with respect to the anticipated minimum inter-onset interval. For example, the timestamps may be quantized in units of 23.2 milliseconds, which is equivalent to 1024 sample intervals if the audio sample was digitized at a conventional rate of 44,100 samples per second. In this case, assuming a maximum music sample length of about 47 seconds, each time stamp may be expressed as an eleven-bit binary number.

The fingerprint being generated by the process 100 is based on the relative location of onsets within the music sample. The fingerprint may subsequently be used to search a music library database containing a plurality of similarly-generated fingerprints of known songs. Since the music sample will be compared to the known songs based on the relative, rather than absolute, timing of onsets, the length of a music sample may exceed the presumed maximum sample length (such that the time stamps assigned at 150 "wrap around" and restart at zero) without significantly degrading the accuracy of the comparison.

At 160, inter-onset intervals (IOIs) may be determined. Each IOI may be the difference between the timestamps associated with two onsets within the same frequency band. IOIs may be calculated, for example, between each onset and the first succeeding onset, between each onset and the second succeeding onset, or between other pairs of onsets.

IOIs may be quantized in time intervals that are reasonably small with respect to the anticipated minimum inter-onset interval. The quantization of the IOIs may be the same as the quantization of the timestamps associated with each onset at 150. Alternatively, IOIs may be quantized in first time units and the timestamps may be quantized in longer time units to reduce the number of bits required for each timestamp. For example, IOIs may be quantized in units of 23.2 milliseconds, and the timestamps may be quantized in longer time units such as 46.4 milliseconds or 92.8 milliseconds. Assuming an average onset rate of about one onset per second, each inter-onset interval may be expressed as a six or seven bit binary number.

At 170, one or more codes may be associated with some or all of the onsets detected at 140. Each code may include one or more IOIs indicating the time interval between the associated onset and a subsequent onset. Each code may also include a frequency band identifier indicating the frequency band in which the associated onset occurred. For example, when the music sample is filtered into eight frequency bands at 130 in the process 100, the frequency band identifier may be a three-bit binary number. Each code may be associated with the timestamp associated with the corresponding onset.

At 170, multiple codes may be associated with each onset. For example, two, three, six, or more codes may be associated with each onset. Each code associated with a given onset may be associated with the same timestamp and may include the same frequency band identifier. Multiple codes associated with the same onset may contain different IOIs or combinations of IOIs. For example, three codes may be generated that include the IOIs from the associated onset to each of the next three onsets in the same frequency band, respectively.

At 180, the codes determined at 170 may be combined to form a fingerprint of the music sample. The fingerprint may be a list of all of the codes generated at 170 and the associated timestamps. The codes may be listed in timestamp order, in timestamp order by frequency band, or in some other order. The ordering of the codes may not be relevant to the use of the fingerprint. The fingerprint may be stored and/or transmitted over a network before the process 100 ends at 190.

Figure 2:
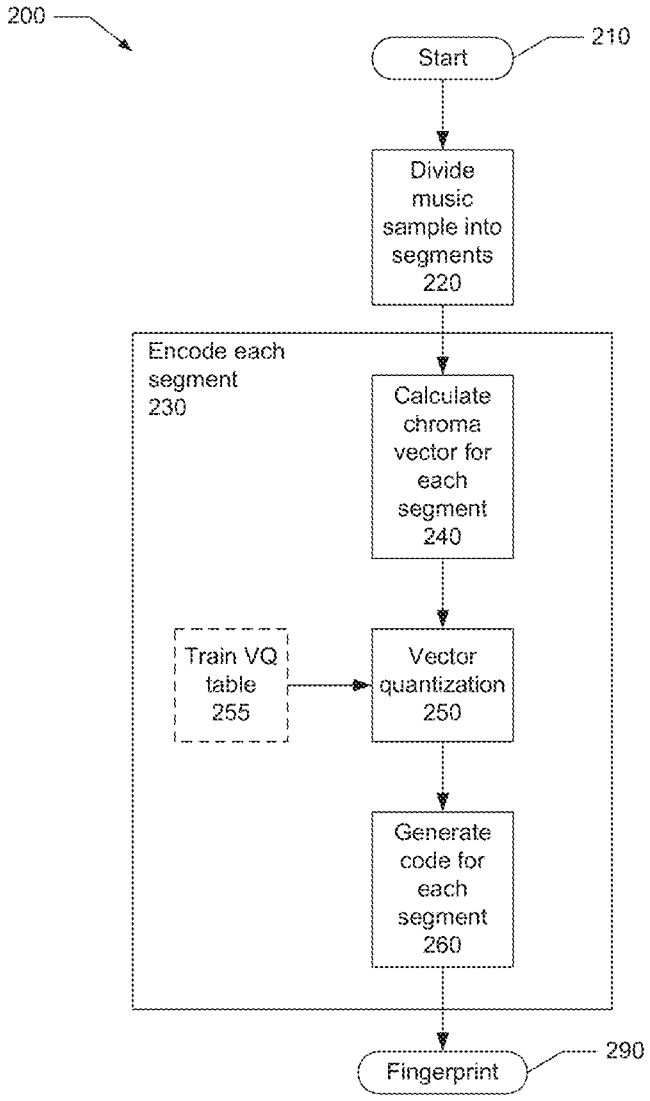
FIG. 2 is a flow chart of another process for generating a fingerprint of a music sample.

FIG. 2 shows a flow chart of another process 200 for converting a music sample into a fingerprint, as described by Ellis, Whitman, Jehan, and Lamere (The Echo Nest musical fingerprint, *International Conference on Music Information Retrieval* (*ISMIR*)2010). The process 200 may begin at 210, when the music sample is provided as a series of time-domain samples, and may end at 290. The process 200 may include dividing the music sample into segments at 220, and then encoding, or developing a code representing, each segment at 230.

At 220, the music sample may be divided into segments. Each segment may, for example, begin with an audible change in the sound of the track commonly termed an "onset". Each segment may begin with a distinct sound commonly termed the "attack" of the segment. On average, a pop song will contain about four segments per second, but the rate widely varies with the sample's complexity and tempo. The duration of segments may range from 60 milliseconds to 500 milliseconds or longer. Published Patent Application US2007/0291958A1 describes processes for developing an audio spectrogram of a track and for segmentation of the track based on onsets detected in the audio spectrogram. These processes may be suitable for use at 220 within the process 200. Paragraphs 0046-0061 and the associated figures of US2007/0291958A1 are incorporated herein by reference. Other processes for dividing the music sample into segments may be used.

At 230, each segment of the music sample identified at 220 may be encoded, which is to say the content of each segment may be compressed into a code representative of the segment. The compression of a segment into a corresponding code may be very lossy, such that it may not be possible to reconstruct the segment based on the code.

For example, a respective chroma vector representative of the spectral content of each segment may be calculated at 240. The chroma vector may be, for example, a twelve-term vector indicating the relative power of the segment within twelve frequency bands. Paragraph 0064 of published Patent Application US2007/0291958A1, incorporated herein by reference, describes a technique for developing a 12-element chroma vector for a segment of a musical track. This technique may be suitable for use at 240 in the process 200.

At 250, each chroma vector may be compressed to a scalar number using the well-known technique of vector quantization. For example, a chroma vector may be compared to a plurality of reference vectors stored in a table or codebook and a determination may be made which reference vector is closest to the chroma vector. An identification number of the closest reference vector is then assigned as the compressed value of the chroma vector. For example, the table or codebook may include 1024 reference vectors such that each chroma vector is compressed to a 10-bit binary value.

Prior to encoding any segments at 250, the vector quantization (VQ) table or codebook may be trained at 255. The VQ table may be trained, for example, by calculating chroma vectors for segments of a large number of songs, such as 10,000 songs, randomly selected from an even larger song library. The reference vectors may then be established using known techniques such that each reference vector is closest to a roughly equal portion of the calculated chroma vectors.

At 260, a code may be generated for each segment of the music sample. For example, a code may be generated by concatenating the results of the vector quantization for three consecutive music segments. Continuing the previous example, if each music segment is compressed to a 10-bit value, three 10-bit values may be combined to form a 30-bit code representing each music segment. The codes may be "hashed", for example by reversing the order of the three 10-bit portions. Each code may be tagged with a timestamp indicating the temporal position of the respective segment within the music sample. Each timestamp may indicate, for example, the delay between the start of the music sample and the start of the respective segment. Other processes for encoding and timestamping each segment of the music sample may be used.

The codes representing the music segments and the associated timestamps constitute a fingerprint of the music sample. The length of the fingerprint at 290 may depend on the number of segments within the music sample, which in turn will depend on the length, tempo, and other aspects of the music sample. A 30-second sample of a typical pop song may result in a fingerprint including 220 30-bit codes with respective timestamps.

Figure 3A:
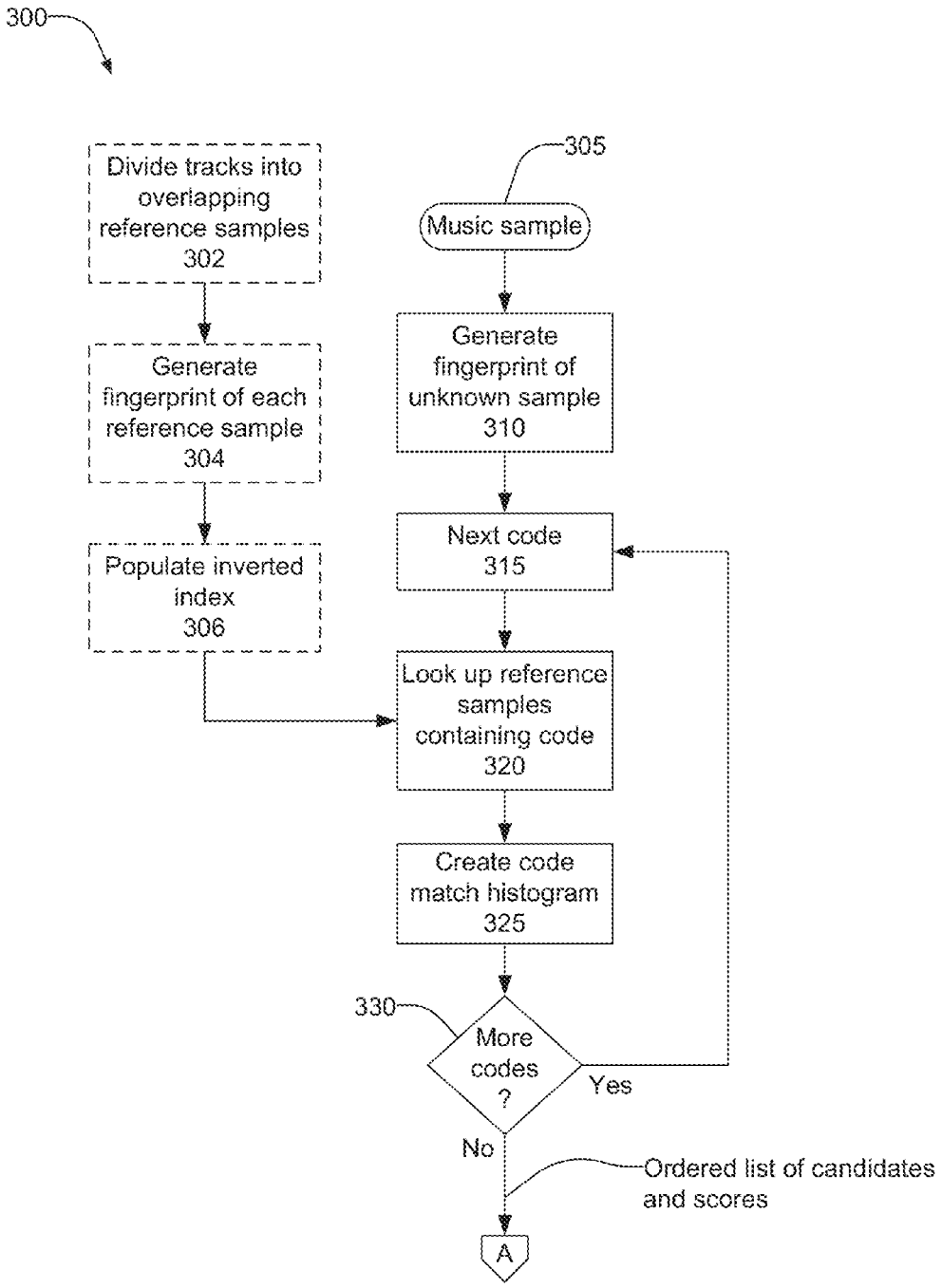
FIG. 3A is a first portion of a flow chart of a process for recognizing music based on a fingerprint.
Figure 3B:
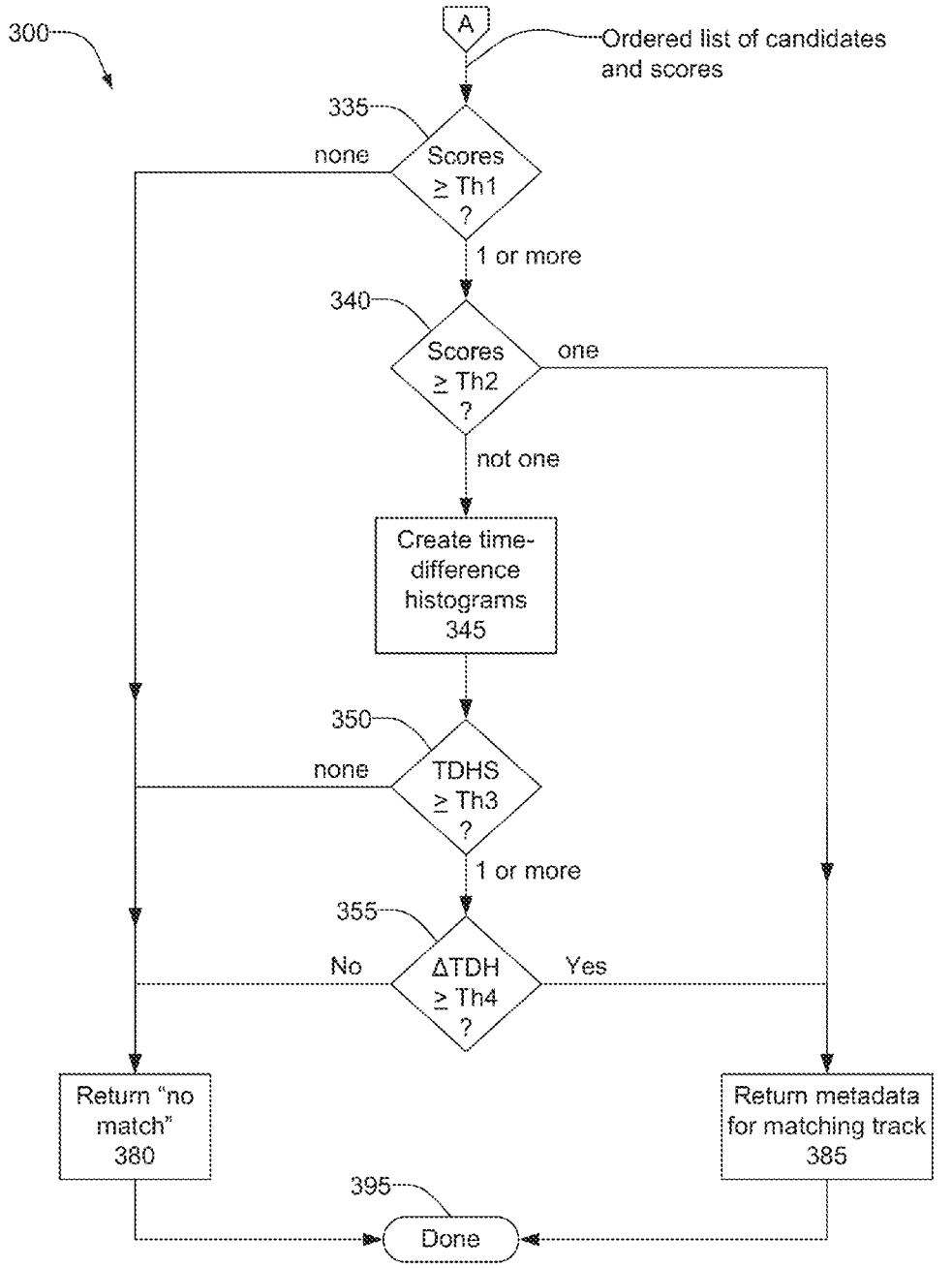
FIG. 3B is a second portion of the flow chart of the process for recognizing music based on a fingerprint.

FIG. 3A and FIG. 3B provided a flow chart of a process 300 for identifying a song based on a fingerprint. Referring first to FIG. 3A, the process 300 may begin at 305 when an unknown music sample is received from a requestor as a series of time domain samples. The process 300 may finish at 395 (FIG. 3B) after a single song from a library of songs has been identified.

At 310, a finger print of the unknown music sample may be generated. The fingerprint may be generated using, for example, the process 100 of FIG. 1, the process 200 of FIG. 2, or some other process. The fingerprint generated at 310 may contain a plurality of codes (which may be compressed or uncompressed) representing the unknown music sample. Each code may be associated with a time stamp.

At 315, a first code from the plurality of codes may be selected. At 320, the selected code may be used to access an inverted index for a music library containing a large plurality of songs.

Figure 4:
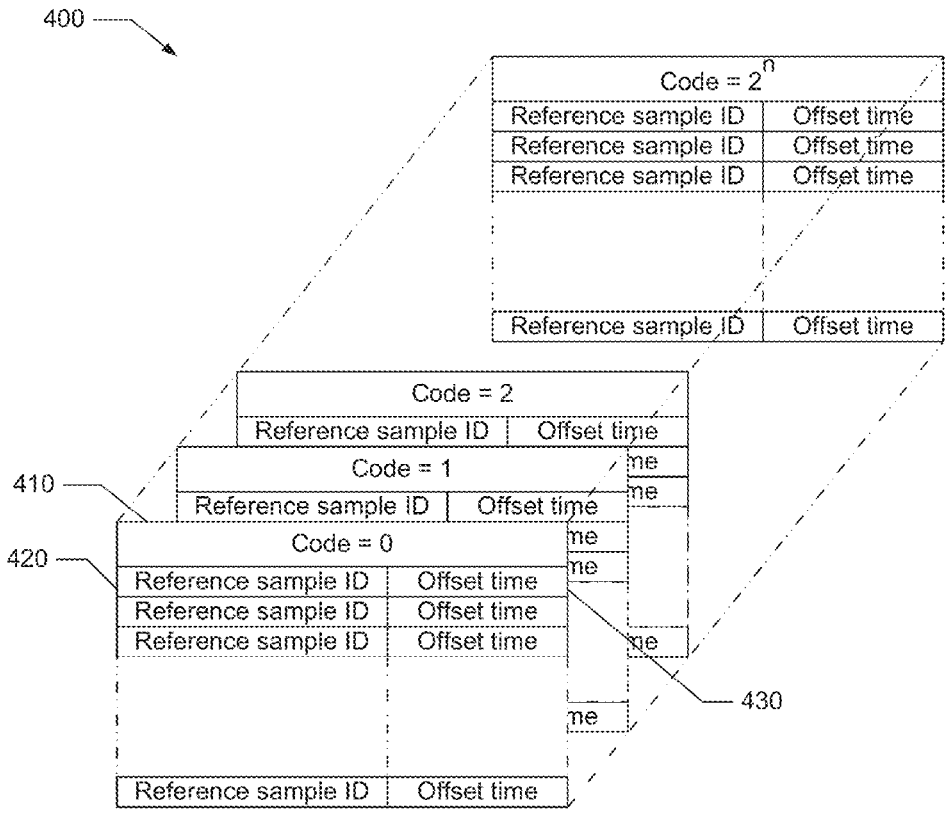
FIG. 4 is a graphical representation of an inverted index.

Referring now to FIG. 4, an inverted index 400 may be suitable for use at 320 in the process 300. The inverted index 400 may include a respective list, such as the list 410, for each possible code value. The code values used in the inverted index may be compressed or uncompressed, so long as the inverted index is consistent with the type of codes within the fingerprint. Continuing the previous examples, in which the music sample is represented by a plurality of 15-bit or 30-bit codes, the inverted index 400 may include $2^{15}$ or $2^{30}$ lists of reference samples. The list associated with each code value may contain the reference sample ID 420 of each reference sample in the music library that contains the code value. Each reference sample may be all or a portion of a track in the music library.

The reference sample ID may be an index number or other identifier that allows the track that contained the reference sample to be identified. The list associated with each code value may also contain an offset time 430 indicating where the code value occurs within the identified reference sample. In situations where a reference sample contains multiple segments having the same code value, multiple offset times may be associated with the reference sample ID.

Referring back to FIG. 3A, an inverted index, such as the inverted index 400, may be populated by first dividing each track in the music library into overlapping reference samples at 302. For example, each track in a music library containing a large number of tracks may be divided into overlapping 30-second or 60-second reference samples. Each track in the music library may be partitioned into reference samples in some other manner.

At 304, a fingerprint may be generated for each reference sample using the same process (e.g. the process 100, the process 200, or some other process) to be used to generate the fingerprint of the unknown music sample at 310. The fingerprints of the tracks may then be used to populate the inverted index at 306.

At 320, the list associated with the code value selected at 315 may be retrieved from the inverted index. At 325, a code match histogram may be developed. The code match histogram may be a list of all of the reference sample IDs for reference samples that match at least one code from the fingerprint and a score associated with each listed reference sample ID indicating how many codes from the fingerprint matched that reference sample.

At 330, a determination may be made if more codes from the fingerprint should be considered. When there are more codes to consider, the actions from 315 to 330 may be repeated cyclically for each code. Specifically, at 320 each additional code may be used to access the inverted index. At 325, the code match histogram may be updated to reflect the reference samples that match the additional codes.

The actions from 315 to 330 may be repeated cyclically until all codes contained in the fingerprint have been processed. The actions from 315 to 330 may be repeated until either all codes from the fingerprint have been processed or until a predetermined maximum number of codes have been processed. The actions from 315 to 330 may be repeated until all codes from the fingerprint have been processed or until the histogram built at 3250 indicates a clear match between the music sample and one of the reference samples. The determination at 330 whether or not to process additional codes may be made in some other manner.

When a determination is made at 330 that no more codes should be processed, the code match histogram may be sorted by score to provide an ordered list of candidate reference samples with their associated scores.

Referring now to FIG. 3B, at 335, the highest score from the ordered list of candidates may be compared to a first predetermined threshold Th1. Th1 may represent a minimum number of codes matches necessary for an unknown sample to possibly match a reference sample. Th1 may be expressed as an absolute number, for example 10 or 20 matches, or as a portion, for example 5% or 10%, of the number of codes in the unknown sample. If the highest score from the ordered list of candidates is less than Th1 (and thus all scores are less than Th1), a message may be returned to the requestor at 380 that the unknown music sample does not match any track in the music library. The process 300 may then end at 395.

When the highest score highest score from the ordered list of candidates is greater than or equal to Th1, the scores from the highest score from the ordered list of candidates may be compared in rank order to a second predetermined threshold Th2 at 340. Th2 may represent a very strong match, for example 80% or 90% of the codes in the unknown music sample, between the unknown music sample and a reference sample. If exactly one score from the ordered list of candidates is greater than or equal to Th2, the unknown sample may be declared to match the one candidate having the highest score. In this case the track description, song title, and other metadata for the matching track (i.e. the track of which the matching reference sample is a segment) may be returned to the requestor at 385. The process 300 may then end at 395.

When a determination is made at 340 that there is not exactly one score greater than or equal to Th2 (i.e. when no score is greater than or equal to Th2 or more than one score is greater than or equal to Th2), the process 600 may continue at 345. At 345, a time-difference histogram may be created for two or more candidate reference samples. A time-difference histogram may be created for a predetermined number of candidates having the highest scores, or all candidates having scores higher than Th1. When two or more candidates have scores higher than Th2, time-difference histograms may be created only for those candidates. For each candidate reference sample, the difference between the associated timestamp from the fingerprint and the offset time from the inverted index may be determined for each matching code and a histogram may be created showing the number of matching codes for each different time-difference value. When the unknown music sample and a candidate reference sample actually match, the histogram may have a pronounced peak. Note that the peak may not be at time=0 because the start of the unknown music sample may not coincide with the start of the reference sample. When a candidate reference sample does not, in fact, match the unknown music sample, the corresponding time-difference histogram may not have a pronounced peak. The two highest values in the respective time-difference histograms may be added to provide a time-difference histogram score (TDH score or TDHS) for each candidate.

Each TDH score indicates how many codes from the unknown music sample match both a code value and a relative temporal position within a candidate reference sample. Thus the TDH scores for the candidates provide a higher degree of discrimination between candidates than just the number of code matches.

At 350, the highest TDH score from 345 compared to a third predetermined threshold Th3. Th3 may represent a minimum number of matches necessary for an unknown sample to be declared to match a reference sample. Th3 may be expressed as an absolute number, for example a score of 10 or 20, or as a portion, for example 5% or 10%, of the total number of codes in the fingerprint from unknown sample. If the highest TDH score from 350 is less than Th3 (and thus all TDH scores are less than Th1), a message may be returned to the requestor at 380 that the unknown music sample does not match any track in the music library. The process 300 may then end at 395.

When the highest score highest score from the ordered list of candidates is greater than or equal to Th3, a difference between the highest TDH score and the second highest TDH score may be evaluated at 355 to determine if the candidate reference samples with the highest TDH score is a match to unknown music sample. For example, the highest TDH score and the second highest TDH score may be evaluated using the formula:

$$\Delta TDH = \frac{TDH_1 - TDH_2}{TDH_1} \geq Th4$$

wherein $TDH_1$ = Maximum $TDH$ score $TDH_2$ = 2nd highest $TDH$ score $Th4$ = fourth predetermined threshold.

Th4 may be expressed as a portion, for example 25% or 33%. If, at 355, a determination is made that ΔTDH is less than Th4, a message may be returned to the requestor at 380 that the unknown music sample does not match any track in the music library. The process 300 may then end at 395. If a determination is made at 355 that ΔTDH is equal to or greater than Th4, the track description, song title, and other metadata for the matching track (i.e. the track of which the matching reference sample is a segment) may be returned to the requestor at 385. The process 300 may then end at 395.

Description of Apparatus

Figure 5:
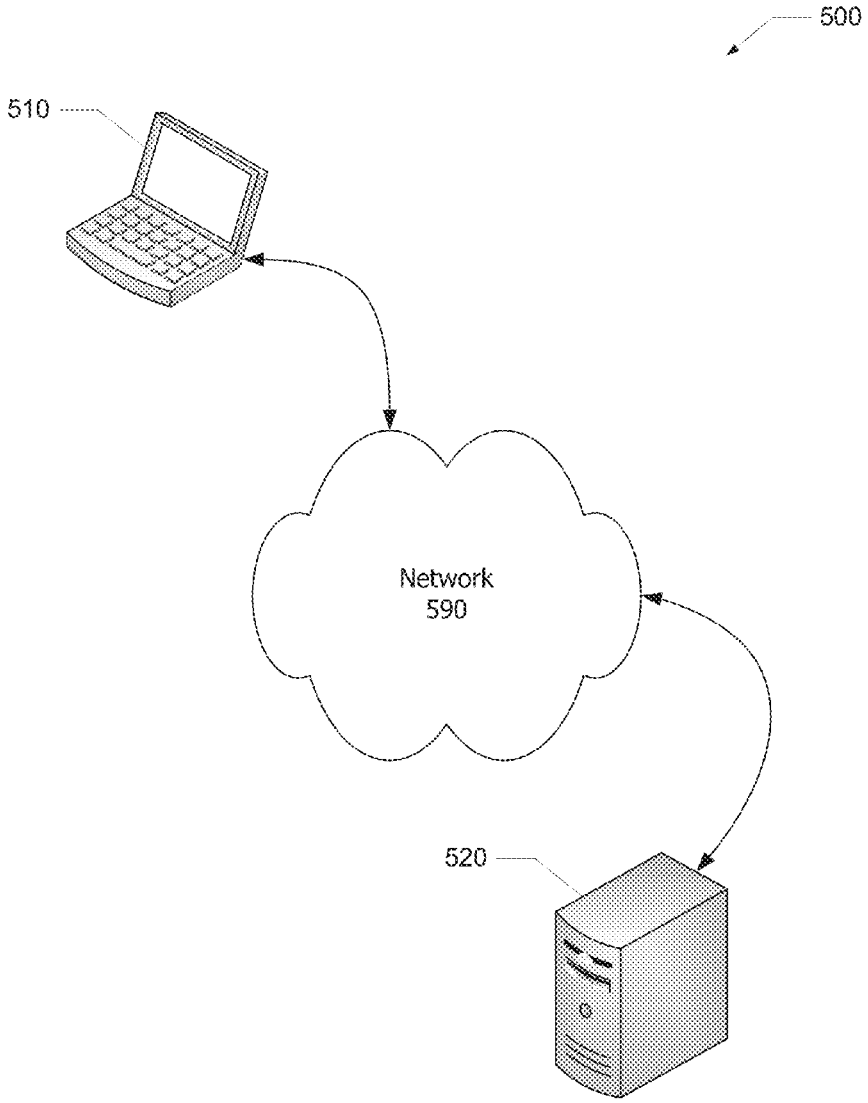
FIG. 5 is a block diagram of a system for fingerprinting music samples.

Referring now to FIG. 5, a system 500 for audio fingerprinting may include a client computer 510, and a server 520 coupled via a network 590. The network 590 may be or include the Internet. Although FIG. 5 shows, for ease of explanation, a single client computer and a single server, it must be understood that a large plurality of client computers and be in communication with the server 520 concurrently, and that the server 520 may comprise a plurality of servers, a server cluster, or a virtual server within a cloud.

Although shown as a portable computer, the client computer 510 may be any computing device including, but not limited to, a desktop personal computer, a portable computer, a laptop computer, a computing tablet, a set top box, a video game system, a personal music player, a telephone, or a personal digital assistant. Each of the client computer 510 and the server 520 may be a computing device including at least one processor, memory, and a network interface. The server, in particular, may contain a plurality of processors. Each of the client computer 510 and the server 520 may include or be coupled to one or more storage devices. The client computer 510 may also include or be coupled to a display device and user input devices, such as a keyboard and mouse, not shown in FIG. 5.

Each of the client computer 510 and the server 520 may execute software instructions to perform the actions and methods described herein. The software instructions may be stored on a machine readable storage medium within a storage device. Machine readable storage media include, for example, magnetic media such as hard disks, floppy disks and tape; optical media such as compact disks (CD-ROM and CD-RW) and digital versatile disks (DVD and DVD±RW); flash memory cards; and other storage media. Within this patent, the term "storage medium" refers to a physical object capable of storing data. The term "storage medium" does not encompass transitory media, such as propagating signals or waveforms.

Each of the client computer 510 and the server 520 may run an operating system, including, for example, variations of the Linux, Microsoft Windows, Symbian, and Apple Mac operating systems. To access the Internet, the client computer may run a browser such as Microsoft Explorer or Mozilla Firefox, and an e-mail program such as Microsoft Outlook or Lotus Notes. Each of the client computer 510 and the server 520 may run one or more application programs to perform the actions and methods described herein.

The client computer 510 may be used by a "requestor" to send a query to the server 520 via the network 590. The query may request the server to identify an unknown music sample. The client computer 510 may generate a fingerprint of the unknown music sample and provide the fingerprint to the server 520 via the network 590. In this case, the process 100 of FIG. 1, the process 200 of FIG. 2, and/or the action 310 in FIG. 3A may be performed by the client computer 510, and the process 300 of FIGS. 3A and 3B (except for 310) may be performed by the server 520. Alternatively, the client computer may provide the music sample to the server as a series of time-domain samples, in which case the entire process 300 of FIG. 3A and FIG. 3B may be performed by the server 520.

Figure 6:
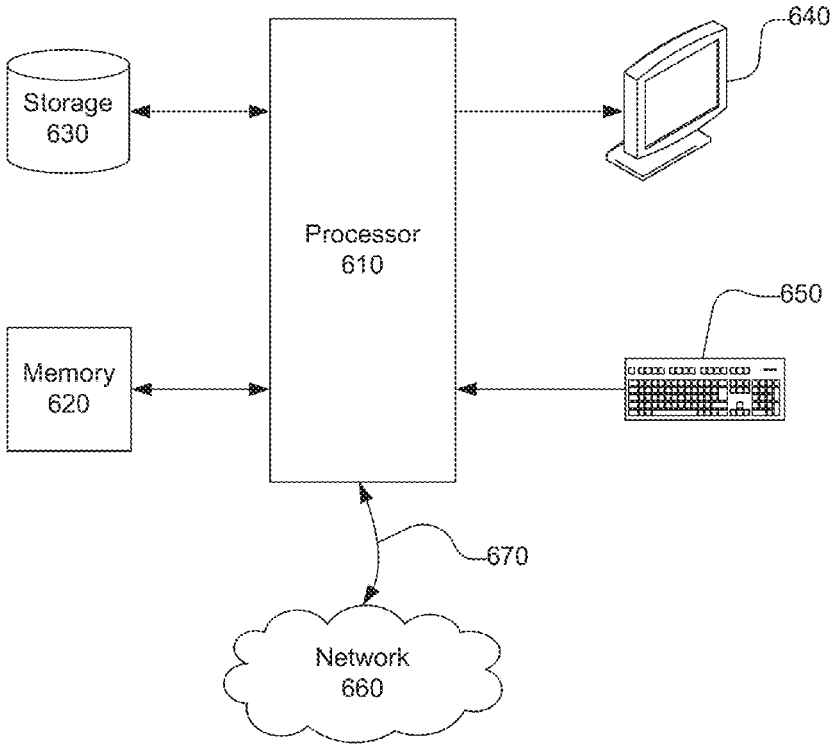
FIG. 6 is a block diagram of a computing device.

FIG. 6 is a block diagram of a computing device 600 which may be suitable for use as the client computer 510 and/or the server 520 of FIG. 5. The computing device 600 may include a processor 610 coupled to memory 620 and a storage device 630. The processor 610 may include one or more microprocessor chips and supporting circuit devices. The storage device 630 may include a machine readable storage medium as previously described. The machine readable storage medium may store instructions that, when executed by the processor 610, cause the computing device 600 to perform some or all of the processes described herein.

The processor 610 may be coupled to a network 660, which may be or include the Internet, via a communications link 670. The processor 610 may be coupled to peripheral devices such as a display 640, a keyboard 650, and other devices that are not shown.

Closing Comments

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

It is claimed:

1. A method for identifying an unknown music sample, comprising:

dividing a plurality of tracks from a music library into overlapping reference samples, each reference sample associated with a unique identifier;

generating a reference fingerprint for each of the reference samples, each reference fingerprint including a plurality of codes associated with a corresponding plurality of offset times;

populating and storing an inverted index from the reference fingerprints, the inverted index including, for each possible code value, a list of identifiers of reference samples having reference fingerprints that contain the respective code value;

receiving an unknown fingerprint derived from the unknown music sample, the unknown fingerprint including a plurality of codes associated with a corresponding plurality of timestamps;

using each of the codes in the unknown fingerprint to retrieve the respective list from the inverted index to build a code match histogram, the code match histogram including a list of candidate reference samples and associated scores, each score indicating a number of codes from the unknown fingerprint that match codes in the corresponding reference fingerprint; and determining whether or not a single candidate reference sample matches the unknown music sample based on the code match histogram.

2. The method of claim 1, wherein determining whether or not a single candidate reference sample matches the unknown music sample based on the code match histogram further comprises:

when a highest score in the code match histogram is less than a first predetermined threshold, determining that the unknown music sample does not match any of the candidate reference samples.

3. The method of claim 1, wherein determining whether or not a single candidate reference sample matches the unknown music sample based on the code match histogram further comprises:

when exactly one score in the code match histogram is greater than or equal to a second predetermined threshold higher than the first predetermined threshold, determining that the unknown music sample matches the candidate reference sample having the highest score.

4. The method of claim 1, wherein determining whether or not a single candidate reference sample matches the unknown music sample based on the code match histogram further comprises:

selecting two or more candidate reference samples having the highest scores;

building a time difference histogram for each selected candidate reference sample, building a time difference histogram comprising:

for each code in the reference fingerprint of the candidate that matches a code in the unknown fingerprint, determining a time difference between the timestamp of the code in the unknown fingerprint and the offset time associated with the code in the reference fingerprint, and building the time difference histogram by counting, for each value of the time difference, a number of code matches having the same time difference; and determining whether or not a single candidate reference sample matches the unknown music sample based on the time difference histograms for the two or more candidate reference samples.

5. The method of claim 4, wherein building a time difference histogram further comprises:

adding two highest values for the number of code matches having the same time difference to determine a time-difference histogram score.

6. The method of claim 5, wherein determining whether or not a single candidate reference sample matches the unknown music sample based on the time difference histograms further comprises:

determining that the unknown music sample matches the candidate reference sample having the highest time-difference histogram score if the highest time-difference histogram score is greater than or equal to a third predetermined threshold and if a relative difference between the highest and second-highest time-difference histogram scores is greater than or equal to a fourth predetermined threshold.

7. The method of claim 1, wherein generating a reference fingerprint from a reference sample comprises:

dividing the reference music sample into time segments;

determining a chroma vector for each time segment;

compressing each chroma vector into a corresponding code using vector quantization; and associating each code with an offset time indicating a start time of the respective time segment.

8. The method of claim 6, wherein each time segment begins at an onset.

9. The method of claim 1, wherein generating a reference fingerprint from a reference sample comprises:

dividing the reference music sample into a plurality of frequency bands;

detecting onsets within each frequency band;

generating codes based on time intervals between onsets in the same frequency band.

10. The method of claim 9, wherein each code includes data defining one or more inter-onset intervals and a frequency band identifier.

11. A computing device for identifying an unknown music sample, comprising:

a machine readable storage medium storing instructions that, when executed, cause the computing device to perform actions including:

dividing a plurality of tracks from a music library into overlapping reference samples, each reference sample associated with a unique identifier;

generating a reference fingerprint for each of the reference samples, each reference fingerprint including a plurality of codes associated with a corresponding plurality of offset times;

populating and storing an inverted index from the reference fingerprints, the inverted index including, for each possible code value, a list of identifiers of reference samples having reference fingerprints that contain the respective code value;

receiving an unknown fingerprint derived from the unknown music sample, the unknown fingerprint including a plurality of codes associated with a corresponding plurality of timestamps;

using each of the codes in the unknown fingerprint to retrieve the respective list from the inverted index to build a code match histogram, the code match histogram including a list of candidate reference samples and associated scores, each score indicating a number of codes from the unknown fingerprint that match codes in the corresponding reference fingerprint; and determining whether or not a single candidate reference sample matches the unknown music sample based on the code match histogram.

12. The computing device of claim 11, wherein determining whether or not a single candidate reference sample matches the unknown music sample based on the code match histogram further comprises:

when a highest score in the code match histogram is less than a first predetermined threshold, determining that the unknown music sample does not match any of the candidate reference samples.

13. The computing device of claim 11, wherein determining whether or not a single candidate reference sample matches the unknown music sample based on the code match histogram further comprises:

when exactly one score in the code match histogram is greater than or equal to a second predetermined threshold higher than the first predetermined threshold, determining that the unknown music sample matches the candidate reference sample having the highest score.

14. The computing device of claim 11, wherein determining whether or not a single candidate reference sample matches the unknown music sample based on the code match histogram further comprises:

selecting two or more candidate reference samples having the highest scores;

building a time difference histogram for each selected candidate reference sample, building a time difference histogram comprising:

for each code in the reference fingerprint of the candidate that matches a code in the unknown fingerprint, determining a time difference between the timestamp of the code in the unknown fingerprint and the offset time associated with the code in the reference fingerprint, and building the time difference histogram by counting, for each value of the time difference, a number of code matches having the same time difference; and determining whether or not a single candidate reference sample matches the unknown music sample based on the time difference histograms for the two or more candidate reference samples.

15. The computing device of claim 14, wherein building a time difference histogram further comprises:

adding two highest values for the number of code matches having the same time difference to determine a time-difference histogram score.

16. The computing device of claim 15, wherein determining whether or not a single candidate reference sample matches the unknown music sample based on the time difference histograms further comprises:

determining that the unknown music sample matches the candidate reference sample having the highest time-difference histogram score if the highest time-difference histogram score is greater than or equal to a third predetermined threshold and if a relative difference between the highest and second-highest time-difference histogram scores is greater than or equal to a fourth predetermined threshold.

17. The computing device of claim 11, wherein generating a reference fingerprint from a reference sample comprises:

dividing the reference music sample into time segments;

determining a chroma vector for each time segment;

compressing each chroma vector into a corresponding code using vector quantization; and associating each code with an offset time indicating a start time of the respective time segment.

18. The computing device of claim 17, wherein each time segment begins at an onset.

19. The computing device of claim 11, wherein generating a reference fingerprint from a reference sample comprises:

dividing the reference music sample into a plurality of frequency bands;

detecting onsets within each frequency band;

generating codes based on time intervals between onsets in the same frequency band.

20. The computing device of claim 19, wherein each code includes data defining one or more inter-onset intervals and a frequency band identifier.

21. The computing device of claim 11, further comprising:

a storage device comprising the machine readable storage medium; and a processor and memory coupled to the storage device and configured to execute the instructions.

* * * * *